US006472133B1

(12) United States Patent
Reynolds et al.

(10) Patent No.: US 6,472,133 B1
(45) **Date of Patent: *Oct. 29, 2002**

(54) SILVER HALIDE ELEMENT WITH IMPROVED HIGH TEMPERATURE STORAGE

(75) Inventors: James H. Reynolds; Steven P. Szatynski, both of Rochester; Stephen P. Singer, Spencerport; George J. Burgmaier, Pittsford; Janet N. Younathan, Fairport; Lillian M. Kellogg, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/592,705

(22) Filed: Jun. 13, 2000

(51) Int. Cl.[7] ..... G03C 7/305
(52) U.S. Cl. ..... 430/544; 430/607; 430/614
(58) Field of Search ..... 430/544, 607, 430/614

(56) References Cited

U.S. PATENT DOCUMENTS

| | | | | |
|---|---|---|---|---|
| 3,364,028 A | | 1/1968 | Konig | |
| 3,575,699 A | | 4/1971 | Bloom et al. | |
| 3,649,267 A | | 3/1972 | Carlson et al. | |
| 4,255,510 A | | 3/1981 | Simons et al. | |
| 4,256,881 A | | 3/1981 | Simons et al. | |
| 4,442,290 A | | 4/1984 | Bartels-Keith et al. | |
| 4,888,268 A | | 12/1989 | Itoh et al. | |
| 5,264,583 A | * | 11/1993 | Begley et al. | 548/253 |
| 5,279,929 A | * | 1/1994 | Begley et al. | 430/382 |
| 5,283,163 A | * | 2/1994 | Lestina et al. | 430/505 |
| 5,288,593 A | * | 2/1994 | Begley et al. | 430/382 |
| 5,451,496 A | * | 9/1995 | Merleet et al. | 430/544 |
| 5,455,151 A | * | 10/1995 | Matejec et al. | 430/505 |
| 5,478,711 A | * | 12/1995 | Chen et al. | 430/544 |
| 5,538,837 A | * | 7/1996 | Mihayashi et al. | 430/505 |
| 5,567,577 A | * | 10/1996 | Welter et al. | 430/544 |
| 6,190,849 B1 | * | 2/2000 | Bums et al. | 430/544 |
| 6,159,672 A | * | 12/2000 | Rieger et al. | 430/506 |

FOREIGN PATENT DOCUMENTS

| | | | |
|---|---|---|---|
| EP | 9989 | * | 4/1980 |
| EP | 485965 | * | 5/1992 |
| EP | 576087 | * | 12/1993 |
| GB | 2010818 | * | 7/1979 |
| GB | 2062884 | | 5/1981 |
| JP | 7-311433 | * | 11/1995 |

* cited by examiner

*Primary Examiner*—Janet Baxter
*Assistant Examiner*—Amanda C. Walke
(74) *Attorney, Agent, or Firm*—Sarah Meeks Roberts

(57) ABSTRACT

This invention relates to a silver halide photographic element comprising at least one silver halide emulsion layer containing a dye-forming coupler which reacts with an oxidized color developing agent to form dye, said silver halide element further comprising an amido compound of Formula I

I wherein INH is a development inhibitor;

LINK is a linking or timing group and m is 0, 1 or 2; and wherein INH is a development inhibitor;

$R^1$ and $R^2$ independently represent an aliphatic, aromatic or heterocyclic group, or $R^1$ and $R^2$ together with the nitrogen to which they are attached represent the atoms necessary to form a 5 or 6 membered ring or multiple ring system, or $R^1$ and $R^2$ are independently a —C(=O)(LINK)$_m$—INH group, or are substituted with an —NR$^{3a}$C(=O)—(LINK)$_m$—INH group, with $R^{3a}$ being defined the same as $R^1$ or $R^2$, and wherein the compound of Formula I does not substantially react with oxidized developer to release INH.

20 Claims, No Drawings

SILVER HALIDE ELEMENT WITH IMPROVED HIGH TEMPERATURE STORAGE

FIELD OF THE INVENTION

This invention relates to the use of certain amido compounds as stabilizers/antifoggants in silver halide photographic elements.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of reparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions. The chemicals used for preventing fog growth as a result of aging or storage are generally known as emulsion stabilizers.

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds, such as those described in U.S. Pat. Nos. 2,728,663; 2,728,664; and 2,728,665, have been used as additives to control fog. Thiosulfonates and thiosulfonate esters, such as those described in U.S. Pat. Nos. 2,440,206; 2,934,198; 3,047,393; and 4,960,689, have also been employed. Organic dichalcogenides, for example, the disulfide compounds described in U.S. Pat. Nos. 1,962,133; 2,465,149; 2,756,145; 2,935,404; 3,184,313; 3,318,701; 3,409,437; 3,447,925; 4,243,748; 4,463,082; and 4,788,132 have been used not only to prevent formation of fog but also as desensitizers and as agents in processing baths and as additives in diffusion transfer systems Recently, a class of compounds has been reported to have benefits in stabilizing silver halide emulsions against such changes due to storage at high temperature and humidity. This class of sulfur heterocycle are compounds in which one of the two sulfur atoms in a five-membered heterocyclic ring is oxidized either to the tetravalent state (dithiolone dioxide) or to the trivalent state (dithiolone oxide). U.S. Pat. No. 5,693,460 teaches the stabilizing properties of dithiol-3-one 1,1-dioxides. U.S. Pat. No. 5,670,307 describes the combination of dithiol-3-one 1,1-dioxides with sulfinates. U.S. Pat. No. 5,756,278 relates to the combination of water soluble gold sensitizers with dithiolone dioxide compounds for enhanced emulsion sensitivity. U.S. Pat. No. 5,677,119 describes the stabilizing properties of dithiol-3-one 1-oxide in silver halide light sensitive materials.

U.S. Pat. No. 4,255,510 and U.S. Pat. No. 4,256,881 describe blocked benzotriazoles as development restrainers for color diffusion transfer photographic elements. UK Patent GB 2,062,884(A) discloses a photographic dye image-receiving sheet containing a blocked 5-mercaptotetrazole development restrainer. Blocked mercaptotetrazoles are also described in U.S. Pat. No. 4,442,290 and U.S. Pat. No. 4,888,268. In addition, various blocked antifoggants and development restrainers have been disclosed in Japanese Patent No. 586,882 and U.S. Pat. Nos. 3,364,028, 3,575,699 and 3,649,267.

However, despite all the efforts in this field there still remains a need for compounds which act as effective antifoggants in photographic elements which are stored under high temperature conditions.

SUMMARY OF THE INVENTION

This invention provides a silver halide photographic element comprising at least one silver halide emulsion layer containing a dye-forming coupler which reacts with an oxidized color developing agent to form dye, said silver halide element further comprising an amido compound of Formula I

I

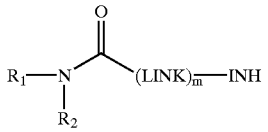

wherein INH is a development inhibitor;

LINK is a linking or timing group and m is 0, 1 or 2; and $R^1$ and $R^2$ independently represent an aliphatic, aromatic or heterocyclic group, or $R^1$ and $R^2$ together with the nitrogen to which they are attached represent the atoms necessary to form a 5 or 6 membered ring or multiple ring system, or $R^1$ and $R^2$ are independently a —C(=O)(LINK)$_m$—INH group, or are substituted with an —NR$^{3a}$C(=O)—LINK)$_m$—INH group, with R$^3$a being defined the same as $R^1$ or $R^2$, and wherein the compound of Formula I does not substantially react with oxidized developer to release INH.

The photographic elements of this invention demonstrate reduced fogging under high temperature conditions. In addition, the amido compounds contained in such elements provide the antifoggant effect only when needed, i.e. at high storage temperatures, thus reducing the possibility of undesirable sensitometric effects. The amido compounds also do not season out of the photographic elements during processing, thereby reducing seasoning of the photographic processing solutions. Unintentional seasoning of such solutions with antifogging or stabilizing compounds can also cause undesirable sensitometric effects.

DETAILED DESCRIPTION OF THE INVENTION

The amido compounds of this invention are blocked antifoggants represented by the following Formula I.

I

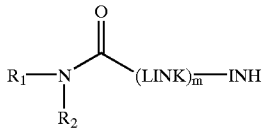

The compounds of Formula I are not couplers and do not substantially react with oxidized color developing agent to form dye and release INH during normal processing conditions. That is, when silver halide photographic elements containing the amido compounds are processed in developer as described below, the INH moiety is not released. A suitable test involves placing an amido compound in the following developer solution; para-phenylenediamine (4.5 g/l), potassium carbonate (34.4 g/l), potassium bicarbonate (2.3 g/l) at pH 10 to which has also been added 1 g/l of potassium ferricyanide to oxidize the developer to Dox. Under these conditions at 40 deg C, inhibitor-releasing couplers that are well known in the art will react substantially in three minutes to form dye and release their inhibitors. However, the materials useful in this invention will undergo less than a 5% reaction under similar conditions.

INH is a development inhibitor moiety. Examples of INH include but are not limited to compounds having a mercapto group bonded to a heterocyclic ring, such as substituted or unsubstituted mercaptoazoles (specifically 1-phenyl-5-mercaptotetrazole, 1-(4-carboxyphenyl)-5-mercaptotetrazole, 1-(3-hydroxyphenyl-5-mercaptotetrazole), 1-(4-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,3,4-thiadiazole, 2-(2-dimethyaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-(3-(3-methylureido) phenyl)-5-mercaptotetrazole, 1-(4-nitrophenyl)-5-mercaptotetrazole, and 1-butyl-5-mercaptotetrazole), substituted or unsubstituted mercaptoazaindenes (specifically 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, and 4,6-dimethyl-2-mercapto-1,3,3a,7-tetraazaindene), and substituted or unsubstituted mercaptopyrimidines (specifically 2-mercaptopyrimidine, 2-mercapto-4-methyl-6-hydroxypyrimidine, and 2-mercapto-4-propylpyrimidine).

INH may also be a subsituted or unsubstituted benzotriazole (specifically benzotriazole, 5-nitrobenzotriazole, 5-methylbenzotriazole, 5,6-dichlorobenzotriazole, 5-bromobenzotriazole, 5-methoxybenzotriazole, 5-(carboxyphenyl)-benzotriazole, 5-n-butylbenzotriazole, 5-nitro-6-cholorbenzotriazole, 5,6-dimethylbenzotriazole, 4,5,6,7-tetrachlorobenzotriazole, and 4,5,6,7-tetrabromobenzotriazole), substituted or unsubstituted indazoles (specifically indazole, 5-nitroindazole, 3-cyanoindazole, 3-chloro-5-nitroindazole, and 3-nitroindazole), and substituted or unsubstituted benzimidazoles (specifically 5-nitrobenzimidazole, 4-nitrobenzimidazole, 5,6-dichlorobenzimidazole, 5-cyano-6-chlorobenzimidazole, and 5-trifluoromethyl-6-chlorobenzimidazole). Preferably INH is a mercaptotetrazole, and most preferably INH is a substituted phenyl mercaptotetrazole.

$R^1$ and $R^2$ can independently be any substituents which are suitable for use in a silver halide photographic element and which do not interfere with the stabilizing activity of the amido compound. $R^1$ and $R^2$ may independently represent a substituted or unsubstituted aliphatic, aromatic or heterocyclic group, or $R^1$ and $R^2$ together with the nitrogen to which they are attached represent the atoms necessary to form a substituted or unsubstituted 5 or 6 membered ring or multiple ring system. $R^1$ and $R^2$ may independently be a —C(=O)(LINK)$_m$—INH group. Also, $R^1$ and $R^2$ may independently be substituted with an —NR$^{3a}$C(=O)—(LINK)$_m$—INH group, with $R^1$ or $R^2$ forming a bridge between two or more inhibitor releasing groups. $R^3$a is defined the same as $R^1$ and $R^2$. This allows the amido compound to be able to release more than one inhibitor moiety.

When $R^1$ and $R^2$ are aliphatic groups, preferably, they are alkyl groups having from 1 to 22 carbon atoms, or alkenyl or alkynyl groups having from 2 to 22 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms. More preferably, the aromatic groups have 6 to 10 carbon atoms and include, among others, phenyl and naphthyl groups. These groups may or may not have substituent groups. The heterocyclic groups are substituted or unsubstituted 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

$R^1$ and $R^2$ may together form a ring or multiple ring system. These ring systems may be unsubstituted or substituted. The ring and multiple ring systems formed by $R^1$ and $R^2$ may be alicyclic or they may be the aromatic and heterocyclic groups described above.

The amido compounds of this invention preferably have a calculated log partition coefficient (c log P) greater than 4.0, and more preferably greater than 7 using MedChem v3.54. (Medicinal Chemistry Project, Pomona College, Claremont, Calif., 1987). In one embodiment of the invention at least one of INH, $R^1$ or $R^2$ contains a ballast group having greater than 6 carbon atoms, and more preferably greater than 10 carbon atoms. More preferably one of $R^1$ or $R^2$ contains a ballast group having greater than 10 carbon atoms.

Nonlimiting examples of substituent groups for INH, $R^1$ and $R^2$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro). INH may also be substituted with a C(=O)NR$^3$R$^4$—INH group.

LINK may be any linking or timing group which does not interfere with the function of the amido compound, although it may modify the rate of release of the inhibitor from the amido compound, and which is suitable for use in a photographic system. m is 0, 1 or 2. Many such linking groups are known to those skilled in the art and some are known as timing groups. They include such as (1) groups utilizing an aromatic nucleophilic substitution reaction as disclosed in U.S. Pat. No. 5,262,291; (2).groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

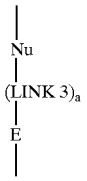

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

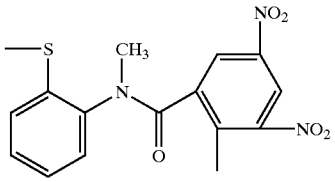

and

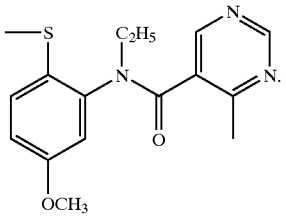

These timing groups are described more fully in U.S. Pat. No. 5,262,291, incorporated herein by reference.

T-2

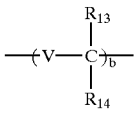

wherein

V represents an oxygen atom, a sulfur atom, or an

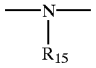

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

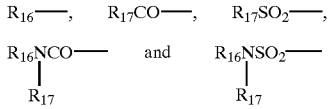

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

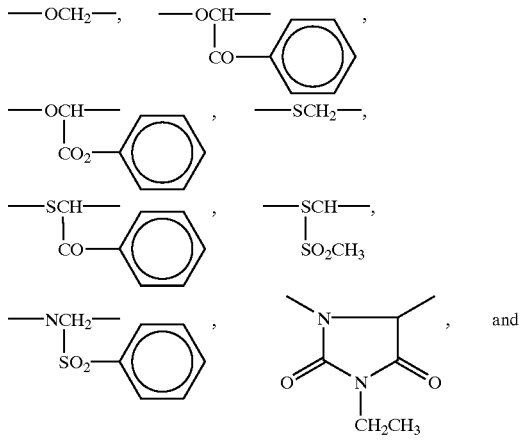

T-3 wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu land E1 to have a steric arrangement such that an intramolecular nucleophilic substition reaction can occur. Specific examples of the group represented by formula (T-3) are illustrated below.

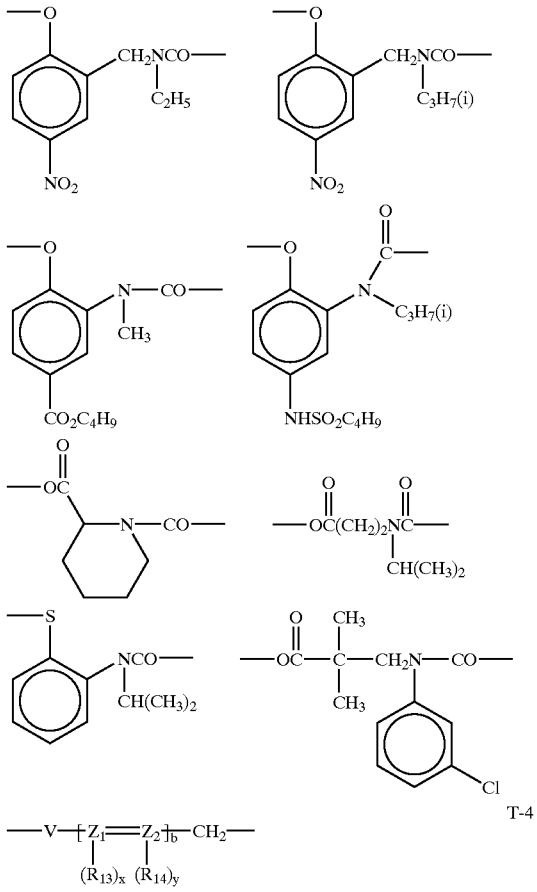

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

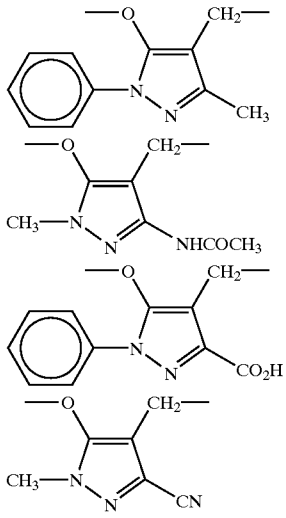

-continued

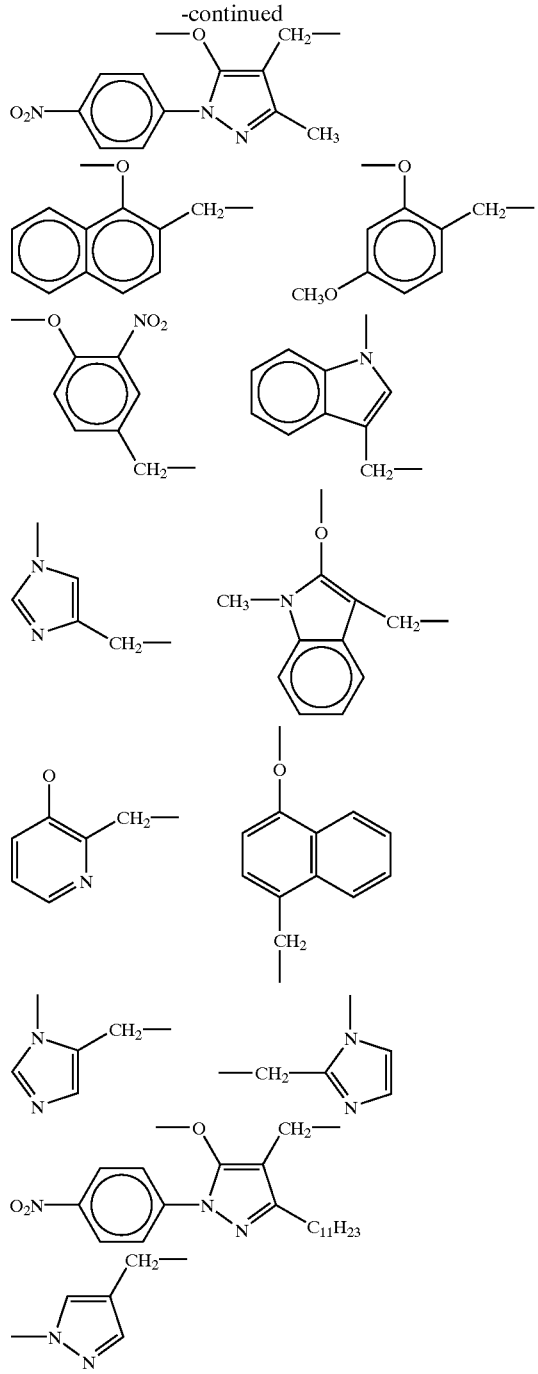

In one embodiment of the invention, LINK is of structure II:

II

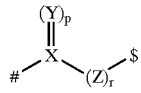

wherein

X represents carbon or sulfur;

Y represents oxygen, sulfur of N—$R_5$, where $R_5$ is substituted or unsubstituted alkyl or substituted or unsubstituted aryl;

p is 1 or 2;
Z represents carbon, oxygen or sulfur;
r is 0 or 1;
with the proviso that when X is carbon, both p and r are 1, when X is sulfur, Y is oxygen, p is 2 and r is 0;
# denotes the bond to INH:
$ denotes the bond to $C(=O)NR^3R^4$—
Illustrative linking groups include, for example,
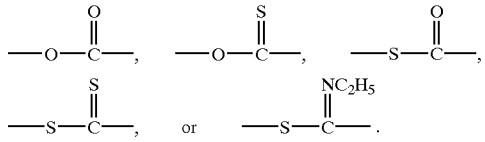
Nonlimiting examples of the amido compounds include the following.
(A)
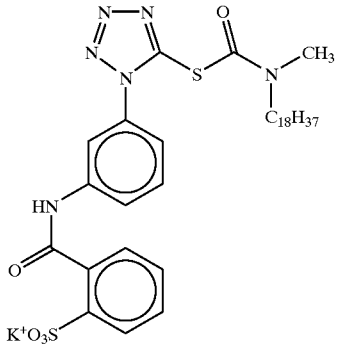
(B)
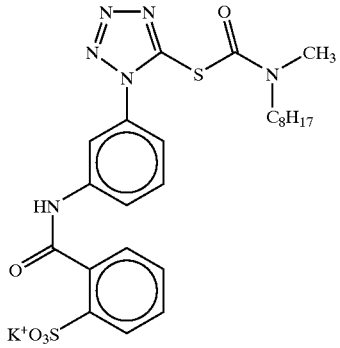
(C)
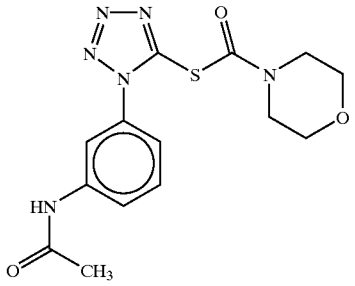
(D)
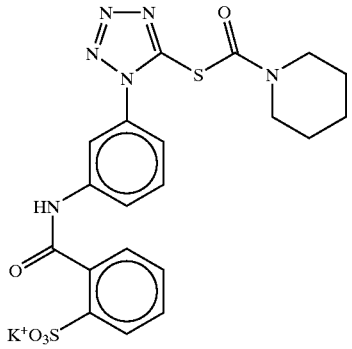
(E)
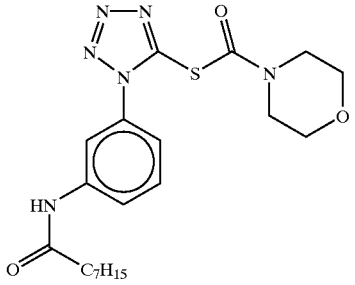
(F)
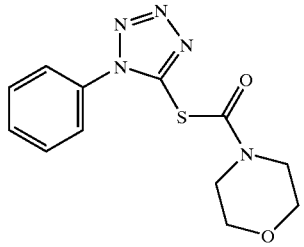
(G)
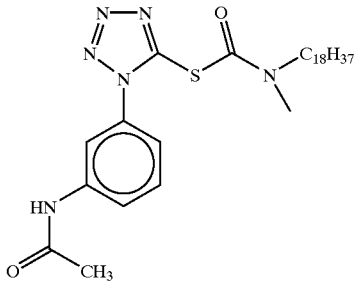
(H)
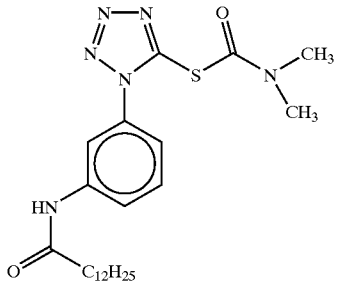

-continued
(I)
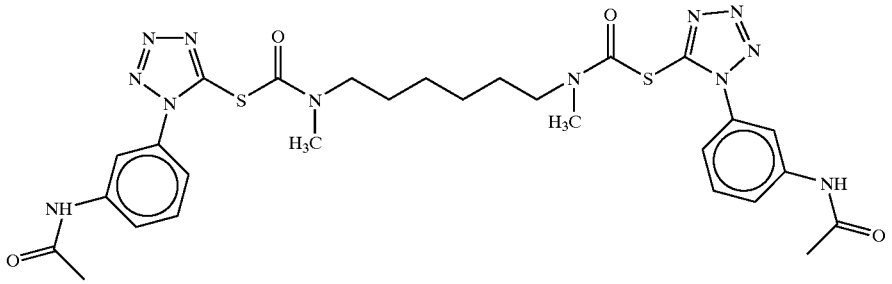
(J)
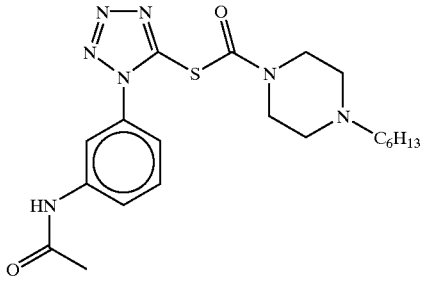
(K)
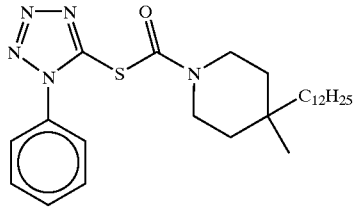
(L)
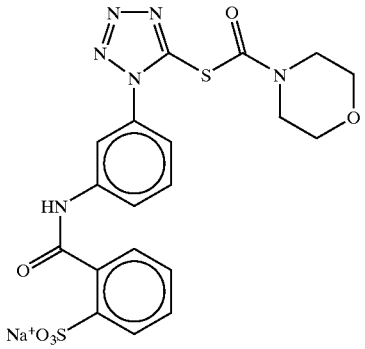
(M)
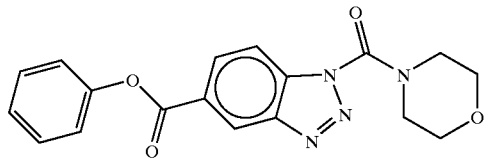
(N)
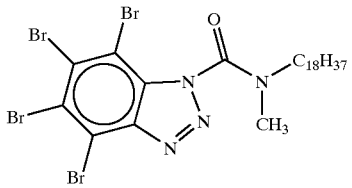
(O)
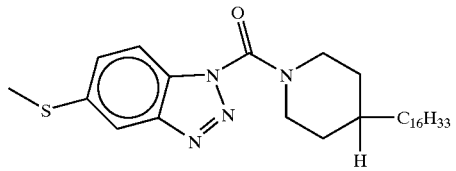
(P)
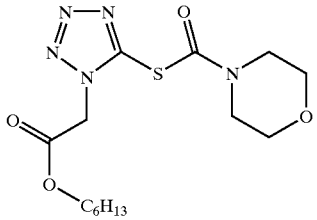
(Q)
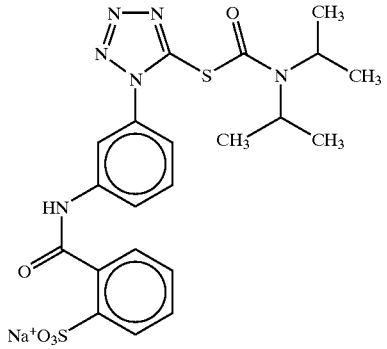

-continued (R)

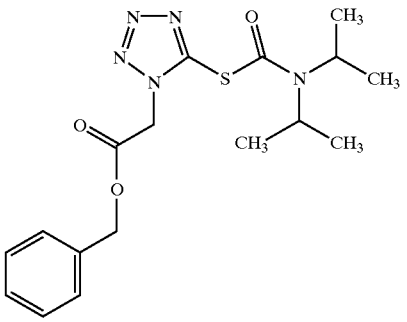

(S)

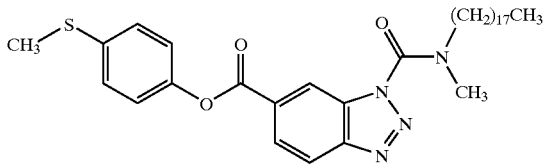

(S)

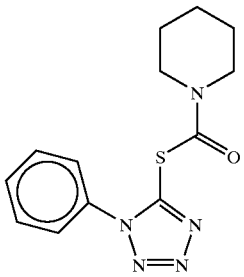

(T)

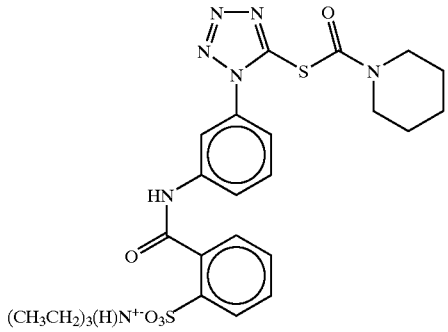

(V)

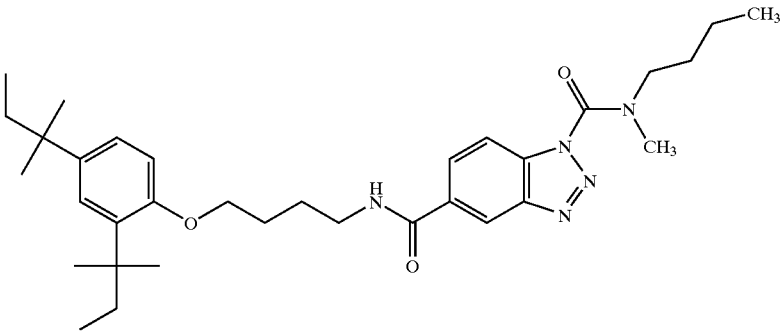

Useful levels of the amido compounds may range from 0.1 micromoles to 1000 micromoles/$m^2$. A more preferred range is from 1 to 100 micromoles/$m^2$ with the most preferred range being from 5 to 50 micromoles/$m^2$.

The amido compounds may be added to the photographic emulsion using any technique suitable for this purpose. They may be dissolved in most common organic solvents, for example, methanol or acetone. They can be added to the emulsion in the form of a liquid/liquid dispersion similar to the technique used with certain couplers or they can also be added as a solid particle dispersion.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The amido compounds may be added to the silver halide emulsion at any time during the preparation of the emulsion i.e. during precipitation, during or before chemical sensitization or during final melting and co-mixing of the emulsions and additives for coating. More preferably these compounds are added after chemical sensitization and most preferably during the final melt.

The amido compounds may be added to any layer where they are in reactive association with the silver halide. By "in reactive association with" it is meant that the compounds must be contained in the silver halide emulsion layer or in a layer whereby they can react or interact with, or come in contact with, the silver halide emulsion. For example, the compounds can also be added to overcoats or interlayers. It is preferred that the amido compounds be contained in the silver halide emulsion layer, particularly for the amido compounds having a c log P greater than 4.

The amido compounds may be utilized in addition to any conventional emulsion stabilizer or antifoggant as commonly practiced in the art. Combinations of amido compounds may also be utilized. It is specifically contemplated that two or more amido compounds having different blocking groups be utilized. It is also specifically contemplated that two or more amido compounds having different INH groups be utilized. Particularly useful may be combinations of different phenyl mercaptotetrazole type INH groups.

The silver halide element also contains at least one dye forming coupler which reacts with oxidized color developer to form image dye. Image dye-forming couplers which may be included in the element such as couplers that form cyan dyes upon reaction with oxidized color developing agents are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. No. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192–350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

The amido compounds of this invention are used in silver halide photographic elements wherein processing is initiated, at least in part, using a liquid. This is as opposed to photothermographic silver halide elements wherein processing is initiated solely by the application of heat to the imaging element. The silver halide photographic elements of the invention may utilize either low volume processing systems or conventional processing systems.

Low volume systems are those where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Conventional photographic elements in accordance with the invention can be processed in any of a number of well-known photographic processes utilizing any of a number of well-known conventional photographic processing solutions, described, for example, in *Research Disclosure* I, or in T. H. James, editor, *The Theory of the Photographic Process*, 4th Edition, Macmillan, N.Y., 1977. The development process may take place for any length of time and any process temperature that is suitable to render an acceptable image. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No, 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. Further, the photographic elements may have an annealed polyethylene naphthalate film base such as described in Hatsumei Kyoukai Koukai Gihou No. 94–6023, published Mar. 15, 1994 (Patent Office of Japan and Library of Congress of Japan) and may be utilized in a small format system, such as described in Research Disclosure, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The silver halide emulsions utilized may be of any silver halide composition, including but not limited to silver bromide, silver bromoiodide, silver chloride, silver chlorobromide, and silver chloroiode. Preferably the silver halide emulsions utilized in this invention are bromoiodide emuslions.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer. The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570. Photographic elements can be exposed to actinic radiation, typically in the visible region of the spectrum, to form a latent image and can then be processed to form a visible dye image as already described above.

The elements as discussed above may serve as origination material for some or all of the following processes: image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure*, September 1994, Item 36544, and *Research Disclosure*, September 1996, Item 38957, Section XIV. Scan facilitating features. These systems to the extent compatible with the color negative element constructions described above are contemplated for use in the practice of this invention. Further examples of such processes and useful film features are also described in U.S. Pat. No. 5,840,470; U.S. Pat. No. 6,045,938; U.S. Pat. No. 6,021,277; EP 961,482 and EP 905,651

For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, Cosgrove et al U.S. Pat. No. 5,644,647, and Reem and Sutton U.S. Pat. No. 5,667,944.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645. Color image reproduction of scenes with color enhancement and preferential tone-scale mapping are described by Burh et al. in U.S. Pat. Nos. 5,300,381 and 5,528,339.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management*, Addison-Wesley, 1998.

The entire contents of the patents and other publications referred to in this specification are incorporated herein by reference.

The following examples are intended to illustrate, but not to limit, the invention.

PREPARATIVE EXAMPLE

Example Synthesis of Compound G

To 125 mL of dry THF was added 9.41 g (40 mmol) of 3-acetamidophenylmercaptotetrazole and 13.84 g (40 mmol) of N-methyl-N-octadecylcarbamyl chloride followed by 6.5 mL (46 mmol) triethylamine. The reaction mixture was stirred at 40 C under the positive pressure of nitrogen for 65 hours. The reaction remained heterogeneous. (The N-methyl-N-octadecylcarbamyl chloride was prepared by reacting N-methyl-N-otadecylamine with one mole of phosgene in the presence of one mole of triethylamine.).

To the reaction was then added 100 mL of dry acetonitrile (4A Molecular Sieves). At this point the reaction became homogeneous. The solution was heated at 52 C for 5 additional days, at which time the solvent was removed on a rotary film evaporator. To the residue was added 200 mL ethyl acetate and 100 mL 0.1 M HCl. The layers were separated and the organic layer was washed with 100 mL cold 5% NaHCO3 solution to remove any unreacted 3-acetamidophenylmercaptotetrazole. The ethyl acetate solution was dried over anhydrous magnesium sulfate, and concentrated to give 21.02 g product. The product was dissolved in a mixture of 100 mL P513 ligroin and 70 mL ethyl acetate at reflux. The material which crystallized at room temperature was collected, washing with a solution of 2 parts P513 ligroin and I part ethyl acetate (v/v), obtaining 17.30 g of a white solid (80% purified yield). HPLC analysis (monitoring at 254 nm) indicated the material was greater than 98 area percent one component. The mass spectrum and proton NMR spectrum were consistent with the desired structure.

Photographic Example.

Multilayer film samples demonstrating the principles of this invention were produced by coating these emulsion samples on cellulose triacetate (coverages are in grams per meter squared unless otherwise stated, emulsion sizes as determined by the Electric Field Birefringence method for diameter and Coated Reflectance method for thickness are reported in Diameter x Thickness in microns).

COMPARATIVE SAMPLE 1

Layer 1 (Antihalation layer): black colloidal silver sol at 0.172; ILS-1 at 0.135, DYE-1 at 0.031; DYE-5 at 0.028; DYE-6 at 0.025; ADD-1 at 0.001; ADD-2 at 0.110; ADD-3 at 0.055; ADD-4 at 0.915; and gelatin at 2.05.

Layer 2 (Slow cyan layer): a blend of two red sensitized (both with a mixture of RSD-1 and RSD-2) tabular silver iodobromide emulsions: (i) 1.0×0.09 microns, 4.1 mole % I at 0.323 (ii) 0.55×0.08 micron, 1.5 mole % I at 0.431; cyan dye-forming coupler C-1 at 0.535; bleach accelerator releasing coupler B-1 at 0.031; masking coupler MC-1 at 0.03; ADD-6 at 1.8g/mol silver and gelatin at 2.024

Layer 3 (Mid cyan layer): a red sensitized (as above)tabular silver iodobromide emulsion: (i) 1.25×0.12, 4.1 mole % I at 0.883; cyan coupler C-1 at 0.105; DIR-1 at 0.093; MC-1 at 0.018; ADD-6 at 1.8g/mol silver and gelatin at 1.012

Layer 4 (Fast cyan layer): a red sensitized (same as above) tabular silver iodobromide emulsion (2.2×0.13, 4.1 mole % I) at 1.076; C-1 at 0.120; DIR-1 at 0.019; MC-1 at 0.032; ADD-6 at 1.8g/mol silver; ADD-7 at 0.05mg/mol silver and gelatin at 1.270

Layer 5 (Interlayer): ILS-1 at 0.075; ADD-9 at 0.002; ADD-8 at 0.001; and gelatin at 0.700.

Layer 6 (Slow magenta layer): a blend of two green sensitized (both with a mixture of GSD-1 and GSD-2) silver iodobromide emulsions: (i) 1.0×0.08 micron, 4.1 mole % iodide at 0.237 and (ii) 0.55×0.08, 1.5 mole % iodide at 0.431; magenta dye forming coupler M-1 at 0.299; MC-2 at 0.041; ADD-6 at 1.8g/mol silver; ADD-1 at 64mg/mol silver; OxDS-1 at 2.8 g/mole silver; and gelatin at 1.27

Layer 7 (Mid magenta layer): a green sensitized (same as above) tabular silver iodobromide emulsion 1.2×0.12, 4.1 mole % I at 1.00; M-1 at 0.82; MC-2 at 0.032; DIR-8 at 0.024; OxDS-1 at 0.045; ADD-6 at 1.8g/mol silver; ADD-7 at 0.05mg/mol silver; and gelatin at 1.465.

Layer 8 (Fast magenta layer): a green sensitized tabular silver iodobromide (2.2×0.13, 4.1 mole % I) emulsion at 1.044; M-l at 0.057; MC-2 at 0.043; DIR-2 at 0.011; DIR-7 at 0.011; OxDS-1 at 0.031; ADD-6 at 1.8 g/mol silver; ADD-7 at 0.1 mg/mol silver and gelatin at 1.251

Layer 9 (Yellow filter layer): yellow filter dye YFD-1 at 0.161; ILS-1 at 0.075; ADD-9 at 0.002; ADD-8 at 0.001; and gelatin at 0.648.

Layer 10: (Slow yellow layer) a blend of three silver iodobromide emulsions blue sensitized with BSD-1: (i) 1.3×0.14 micron, 4.1mole % iodide at 0.184; (ii) 1.0×0.13 micron, 1.5 mole % iodide at 0.227 and (iii) 0.55×0.08, 1.3 mole % iodide at 0.216; yellow dye forming coupler Y-1 at 0.81; DIR-3 at 0.022; B-1 at 0.007; ADD-6 at 1.8g/mol silver and gelatin at 0.594.

Layer 11: (Fast yellow layer) a 2.9×0.14 micron silver iodobromide emulsions blue sensitized with BSD-1I:; yellow dye forming coupler Y-1 at 0.45; DIR-3 at 0.11; B-1 at 0.007; ADD-6 at 1.8g/mol silver and gelatin at 0.1.188.

Layer 12 (UV filter layer): silver bromide Lippman emulsion at 0.216; UV-1 at a total of 0.108; gelatin at 1.242 and bis(vinylsulfonyl)methane hardener at 1.75% of total gelatin weight.

Layer 13 (Protective Overcoat) Matte beads; gelatin at 0.888

Surfactants, coating aids, emulsion addenda, sequestrants, thickeners, lubricants, matte and tinting dyes were added to the appropriate layers as is common in the art. Structures of the materials used in this multilayer format are as follows:

DYE-1
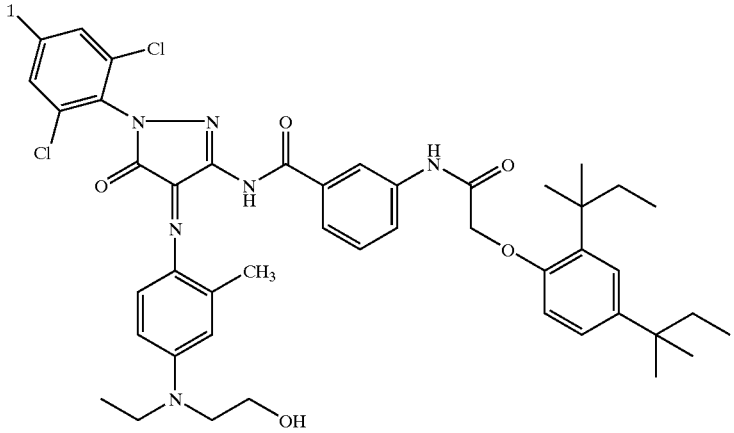
DYE-5
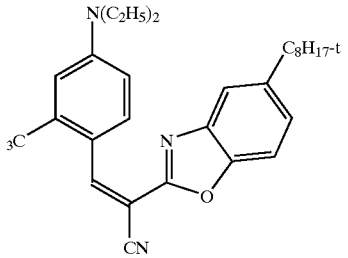
DYE-6
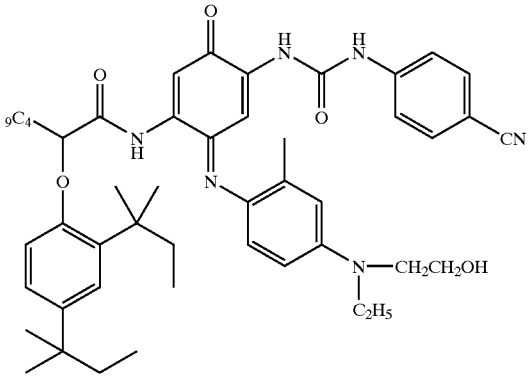
UV-1
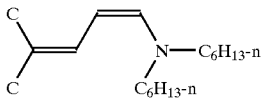
UV-2
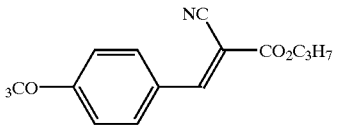
C-1
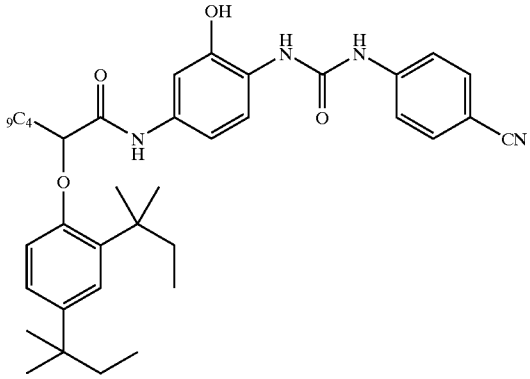
M-1
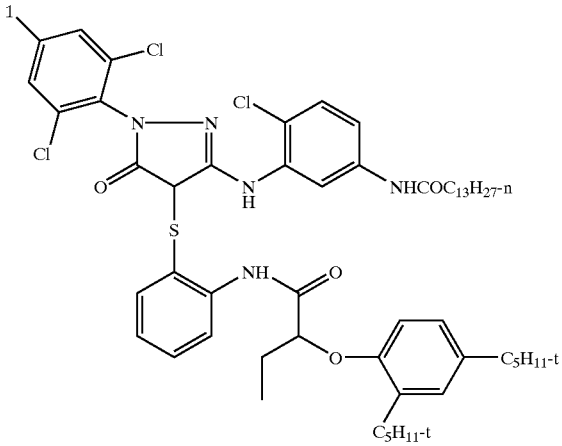

-continued
Y-1
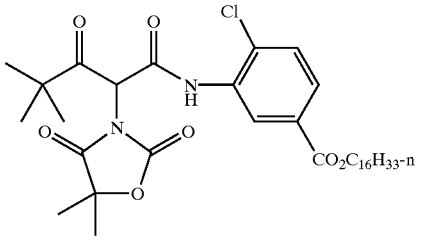
B-1
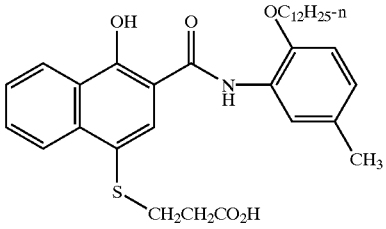
MC-1
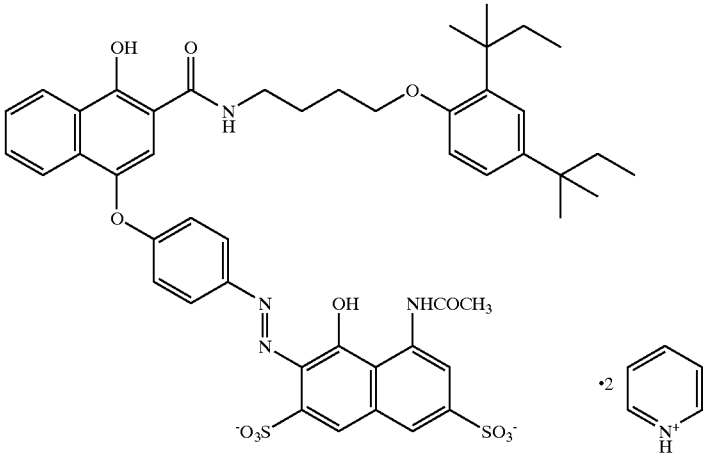
MC-2
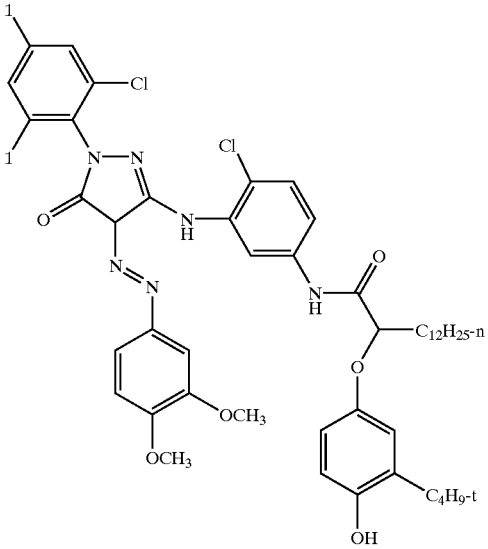
DIR-1
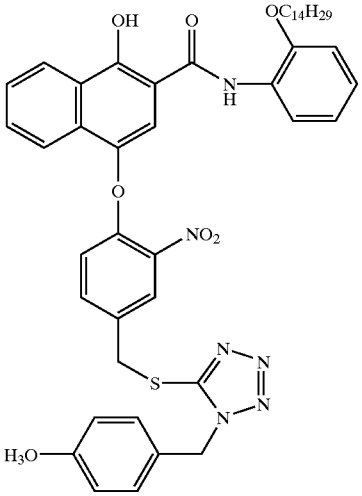
DIR-2
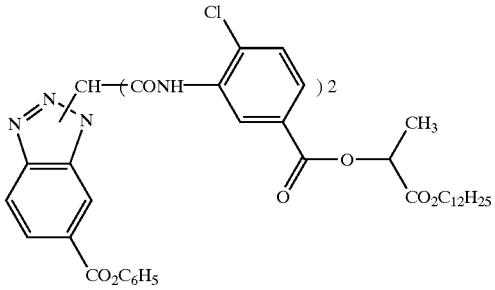
DIR-3
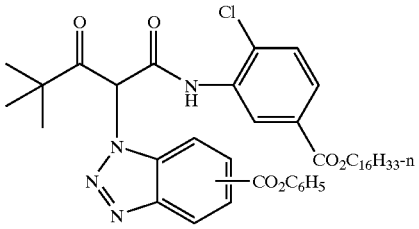

-continued
DIR-7
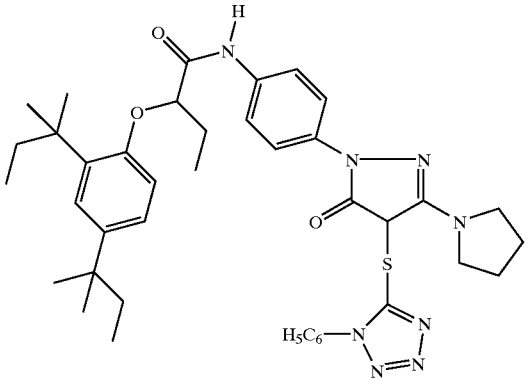
DIR-8
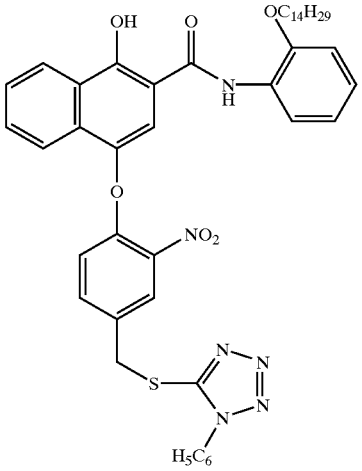
ILS-1
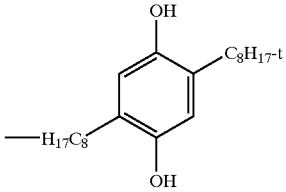
OxDS-1
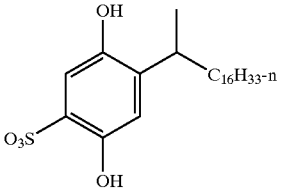
YFD-1
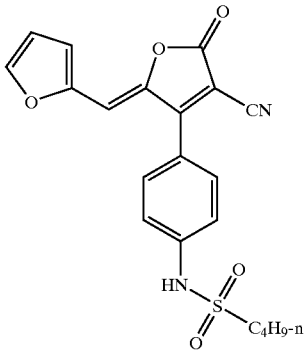
RSD-1
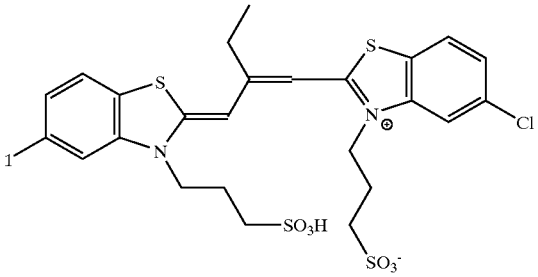
RSD-2
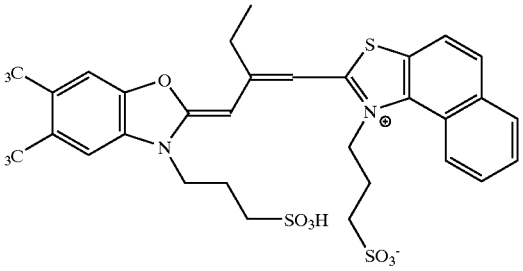
GSD-1
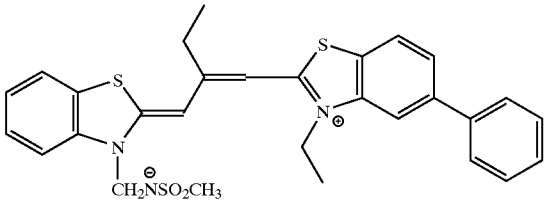

-continued

GSD-2

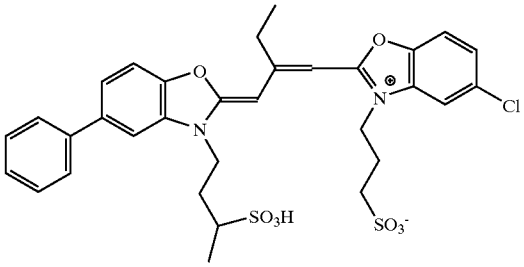

BSD-1

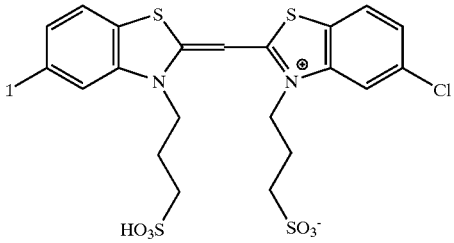

ADD-1

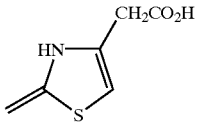

ADD-2

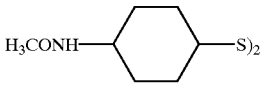

ADD-3

Sodium Hexamethaphosphate

ADD-4

3,5-Disulfocatechol, di-sodium salt

ADD-6

4-Hydroxy-6-methyl-1,3,3a,7-tetrazaidene

ADD-7

$Au_2S$

ADD-8

$MnSO_4$

ADD-9

$PdCl_2$

SURF-1

T2E Triton X200

Invention Sample 2 was equivalent to Sample 1 except 25 micromoles/sq meter of amido Cmpd A was added to layer 10 prior to coating Invention Sample 3 was equivalent to Sample 1 except 25 micromoles/sq meter of amido Cmpd B was added to layer 10 prior to coating Invention Sample 4 was equivalent to Sample 1 except 25 micromoles/sq meter of amido of Cmpd C was added to layer 10 prior to coating Invention Sample 5 was equivalent to Sample 1 except 25 micromoles/sq meter of amido of Cmpd D was added to layer 10 prior to coating Invention Sample 6 was equivalent to Sample 1 except 25 micromoles/sq meter of amido of Cmpd E was added to layer 10 prior to coating Invention Sample 7 was equivalent to Sample 1 except 25 micromoles/sq meter of amido Cmpd F was added to layer 10 prior to coating Comparative Sample 8 was equivalent to Sample 1

The samples were conditioned to 50% rH at 25 degrees C. These samples were then packaged in air-tight and light-tight envelopes and placed in temperature controlled chambers. One chamber was held at 49 degrees C and control coatings were held at -18 degrees C (0 deg F).

After 4 weeks, the samples of each coating were removed from the chambers and given a stepped exposure and processed in the KODAK FLEXICOLOR (C-4 1) process as described in *British Journal of Photography Annual*, 1988, pp 191–198. The minimum densities (D-mins) of the control coatings were subtracted from those of the corresponding high-temperature samples to arrive at a delta D-min value for each sample. The delta D-mins were then normalized against the coating that did not contain an amido compound, and the results are presented in Table 1.

TABLE I

Effect of Amido Compounds on Fog Growth Following Storage for 4 Weeks at 50 deg C./50% RH

| Example | Fog Growth Following Storage |
|---|---|
| Sample 1 (Comp.) | 100 |
| Sample 2 (Inv.) | 39 |
| Sample 3 (Inv.) | 27 |
| Sample 4 (Inv.) | 0 |
| Sample 5 (Inv.) | 1 |
| Sample 6 (Inv.) | 77 |
| Sample 7 (Inv.) | 67 |
| Sample 8 (Comp.) | 100 |

As the data in Table I show, the compounds of the invention are effective at reducing fog growth in the photographic elements during high-temperature storage.

To measure the propensity of the amido compounds to season out of film and into developer solution, the following test was run. Unexposed film samples (35×305 mm) containing the amido compounds were placed in 500 cc of Kodak T-174 developer solution for 3.25 min at 40 deg C. The strips were then removed and the solution was held at 40 deg C for 24 hours. The concentration of inhibitor fragment in solution was then measured by high-pressure liquid chromatography (HPLC), and the result is expressed in Table II as a percent of the maximum concentration that would result if all of the amido compound had diffused out of a film sample during processing and deblocked. A lower percent is desirable to prevent poisoning of developer solution. As the data in Table II demonstrate, the preferred compounds of the invention with ClogP values greater than 4 do not lead to measurable inhibitor levels in the developer.

TABLE II

Seasoning Data for Amido Compounds

| Compound | Compound ClogP | Percent of Inhibitor Detected in Simulated Seasoning |
|---|---|---|
| A | 10.9 | Below detection limit |
| B | 5.6 | Below detection limit |
| C | 3.1 | 69.4 |
| D | 3.1 | 63.5 |
| F | 1.6 | 61.8 |
| S | 15.0 | Below detection limit |
| T | 3.6 | 37.9 |
| U | 3.1 | 78.2 |
| V | 11.4 | Below detection limit |

The invention has been described in detail with particular reference to certain preferred embodiments thereof, but it will be understood that variations and modifications can be effected within the spirit and scope of the invention.

What is claimed is:

1. A silver halide photographic element comprising at least one silver halide emulsion layer containing a dye-forming coupler which reacts with an oxidized color developing agent to form a dye, said silver halide element further comprising an amido compound of Formula I

I

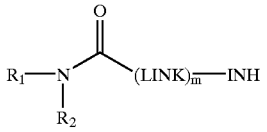

wherein INH is a development inhibitor;

LINK is a linking or timing group and m is 0, 1 or 2; and $R^1$ and $R^2$ independently represent an aliphatic, aromatic or heterocyclic group, or $R^1$ and $R^2$ together with the nitrogen to which they are attached represent the atoms necessary to form a 5 or 6 membered ring or multiple ring system, or $R^1$ and $R^2$ are independently a —C(=O)(LINK)$_m$—INH group, or are substituted with an —NR$^{3a}$C(=O)—(LINK)$_m$—INH group, with R$^{3a}$ being defined the same as $R^1$ or $R^2$, and wherein the compound of Formula I does not substantially react with oxidized developer to release INH.

2. The silver halide element of claim 1 wherein the c log P of the amido compound is greater than 4.

3. The silver halide element of claim 2 wherein the c log P of the amido compound is greater than 7.

4. The silver halide element of claim 1 wherein INH is a mercaptotetrazole.

5. The silver halide element of claim 2 wherein INH is a mercaptotetrazole.

6. The silver halide element of claim 4 wherein INH is a substituted phenyl mercaptotetrazole.

7. The silver halide element of claim 5 wherein INH is a substituted phenyl mercaptotetrazole.

8. The silver halide element of claim 2 wherein at least one of INH, $R^1$ or $R^2$ contains a ballast group having greater than 6 carbon atoms.

9. The silver halide element of claim 8 wherein at least one of $R^1$ or $R^2$ contains a ballast group having greater than 10 carbon atoms.

10. The silver halide element of claim 5 wherein at least one of INH, $R^1$ or $R^2$ contains a ballast group having greater than 6 carbon atoms.

11. The silver halide element of claim 10 wherein at least one of $R^1$ or $R^2$ contains a ballast group having greater than 10 carbon atoms.

12. The silver halide element of claim 1 wherein the amido compound is

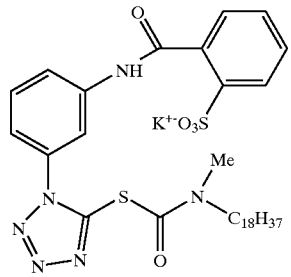

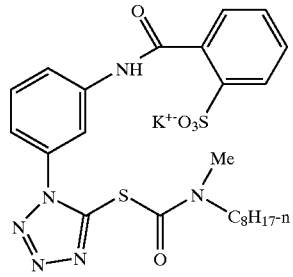

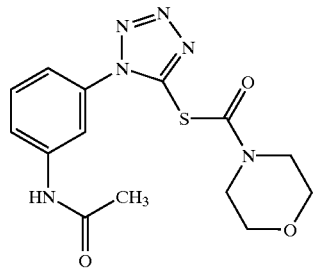

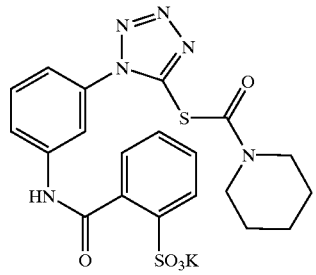

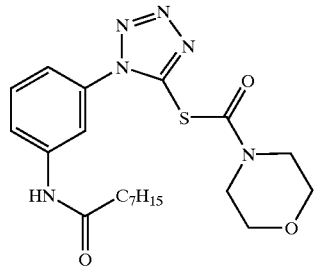

or

-continued

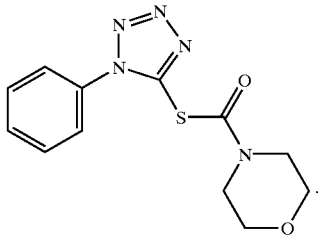

13. The silver halide element of claim 1 wherein silver halide element comprises at least two amido compounds each having a different INH moiety.

14. The silver halide element of claim 13 wherein the INH moieties are both phenyl mercaptotetrazole type moieties.

15. The silver halide photographic element of claim 1 wherein m is 0.

16. The silver halide element of claim 1 wherein LINK is represented by formula T-1

T-1

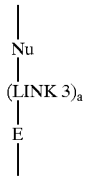

wherein:

Nu is a nucleophilic group,

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

17. The silver halide element of claim 1 wherein LINK is represented by formula T-2;

T-2

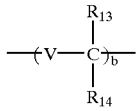

wherein

V represents an oxygen atom, a sulfur atom, or an

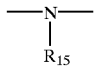

group;

$R_{13}$ and $R_{14}$ each represents a hydrogen atom or a substituent group;

$R_{15}$ represents a substituent group; and b represents 1 or 2.

18. The silver halide element of claim 1 wherein LINK is represented by formula T-3;

-Nu1-LINK4-E1- T-3 wherein

Nu 1 represents a nucleophilic group, E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur.

19. The silver halide element of claim 1 wherein LINK is represented by formula T-4;

T-4

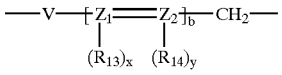

werein

V represents an oxygen atom, a sulfur atom, or an

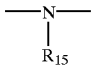

group;

$R_{13}$ and $R_{14}$ each represents a hydrogen atom or a substituent group, wherein $R_{13}$ and $R_{14}$ may be joined together to form a benzene ring or a heterocyclic ring, or V may be joined with $R_{13}$ or $R_{14}$ to form a benzene or heterocyclic ring, b represents 1 or 2; $Z_1$ and $Z_2$ each independently represents a carbon atom or a nitrogen atom, and x and y each represents 0 or 1.

20. The silver halide element of claim 1 wherein LINK is represented by formula LINK II

LINK II

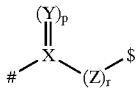

wherein

X represents carbon or sulfur;

Y represents oxygen, sulfur of N-$_5$, where $R_5$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to INH: and $ denotes the bond to C(=O)$NR^3R^4$—.

* * * * *